US005667371A

United States Patent [19]

Prenger et al.

[11] Patent Number: 5,667,371

[45] Date of Patent: Sep. 16, 1997

[54] SCROLL MACHINE WITH MUFFLER ASSEMBLY

[75] Inventors: Werner H. Prenger, Coldwater; Sunil S. Kulkarni, Vandalia, both of Ohio

[73] Assignee: Copeland Corporation, Sidney, Ohio

[21] Appl. No.: 628,050

[22] Filed: Apr. 8, 1996

[51] Int. Cl.[6] ..... F04C 18/04; F04C 29/06; F01N 1/06

[52] U.S. Cl. ..... 418/55.1; 418/181; 181/403

[58] Field of Search ..... 418/55.1, 181; 417/312; 181/229, 403

[56] References Cited

U.S. PATENT DOCUMENTS

| | | | |
|---|---|---|---|
| 3,577,891 | 5/1971 | Nemoto et al. | 417/312 |
| 3,736,074 | 5/1973 | Kilbane et al. | 417/312 |
| 4,518,323 | 5/1985 | Elson et al. | 417/312 |
| 4,547,131 | 10/1985 | Riffe et al. | 417/53 |
| 5,173,042 | 12/1992 | Chambers | 418/55.1 |
| 5,247,736 | 9/1993 | Fraser, Jr. et al. | 418/55.1 |
| 5,346,375 | 9/1994 | Akiyama et al. | 418/55.1 |
| 5,427,511 | 6/1995 | Caillat et al. | 418/55.1 |

FOREIGN PATENT DOCUMENTS

| | | | |
|---|---|---|---|
| 61-205386 | 9/1986 | Japan | 418/55.1 |
| 5-79477 | 3/1993 | Japan | 418/55.1 |
| 5195971 | 8/1993 | Japan | 418/55.1 |
| 6-58281 | 3/1994 | Japan | 418/55.1 |

*Primary Examiner*—John J. Vrablik
*Attorney, Agent, or Firm*—Harness, Dickey & Pierce, P.L.C.

[57] ABSTRACT

A scroll machine has a muffler which is located between a discharge port located in the scroll assembly and a discharge chamber located in a hermetic shell. The muffler has a top cap which is attached to a partition which defines the discharge chamber. A muffler is attached to the top cap and extends towards the scroll assembly through an opening in the partition. The muffler has a generally cylindrical body with two end caps having a spherical surface. The cylindrical body and the end caps define a plurality of perforations which comprise a specific percentage of the total area of these components.

14 Claims, 4 Drawing Sheets

SCROLL MACHINE WITH MUFFLER ASSEMBLY

FIELD OF THE INVENTION

The present invention relates generally to scroll type machines. More particularly, the present invention relates to a scroll type compressor incorporating a muffler assembly within the discharge or muffler chamber of the compressor.

BACKGROUND AND SUMMARY OF THE INVENTION

Scroll machines in general and particularly scroll compressors are generally provided with a hermetic shell which defines a chamber within which is disposed a working fluid. A partition within the shell divides the chamber into a discharge pressure zone and a suction pressure zone. A scroll assembly is located within the suction pressure zone for compressing the working fluid. Generally, these scroll assemblies incorporate a pair of intermeshed spiral wraps, one of which is caused to orbit relative to the other so as to define one or more moving chambers which progressively decrease in size as they travel from an outer suction port towards a center discharge port. An electric motor is normally provided which operates to drive the orbiting scroll wrap via a suitable drive shaft.

The partition within the shell must allow compressed fluid exiting the center discharge port of the scroll assembly to enter the discharge pressure zone within the shell while simultaneously maintaining the integrity between the discharge pressure zone and the suction pressure zone. This function of the partition is normally accomplished by a seal which interacts with the partition and with the scroll member defining the center discharge port.

The discharge pressure zone of the hermetic shell can also function as a muffler chamber and is normally provided with a discharge fluid port which communicates with a refrigeration circuit or some other type of fluid circuit. The opposite end of the fluid circuit is connected with the suction pressure zone of the hermetic shell using a suction fluid port extending through the shell into the suction pressure zone. Thus the scroll machine receives the working fluid from the suction pressure zone of the hermetic shell, compresses this working fluid in the one or more moving chambers defined by the scroll assembly and discharges the compressed working fluid into the discharge pressure zone of the compressor. The compressed working fluid is directed through the discharge port to the fluid circuit and returns to the suction pressure zone of the hermetic shell through the suction port.

Various methods and devices have been developed which function to reduce or eliminate any noise, or the like, generated by the operation of the scroll machine. When the scroll machine is used as a compressor in both refrigeration as well as air conditioning and heat pump applications, it is particularly advantageous to maintain the lowest operational noise level as possible. Accordingly, the continued development of scroll machines and their fluid systems has been directed to reducing the operational noise levels of the machines while still maintaining the extremely efficient operation for which scroll machines are well known.

The present invention provides the art with a muffler assembly which is located between the center discharge port of the scroll assembly and the discharge pressure zone of the hermetic shell. The muffler assembly significantly reduces the operational noise created by the scroll machine without significantly affecting the flow of the working fluid between the canter discharge port of the scroll assembly and the discharge pressure zone of the hermetic shell.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENTS

Figure 1:
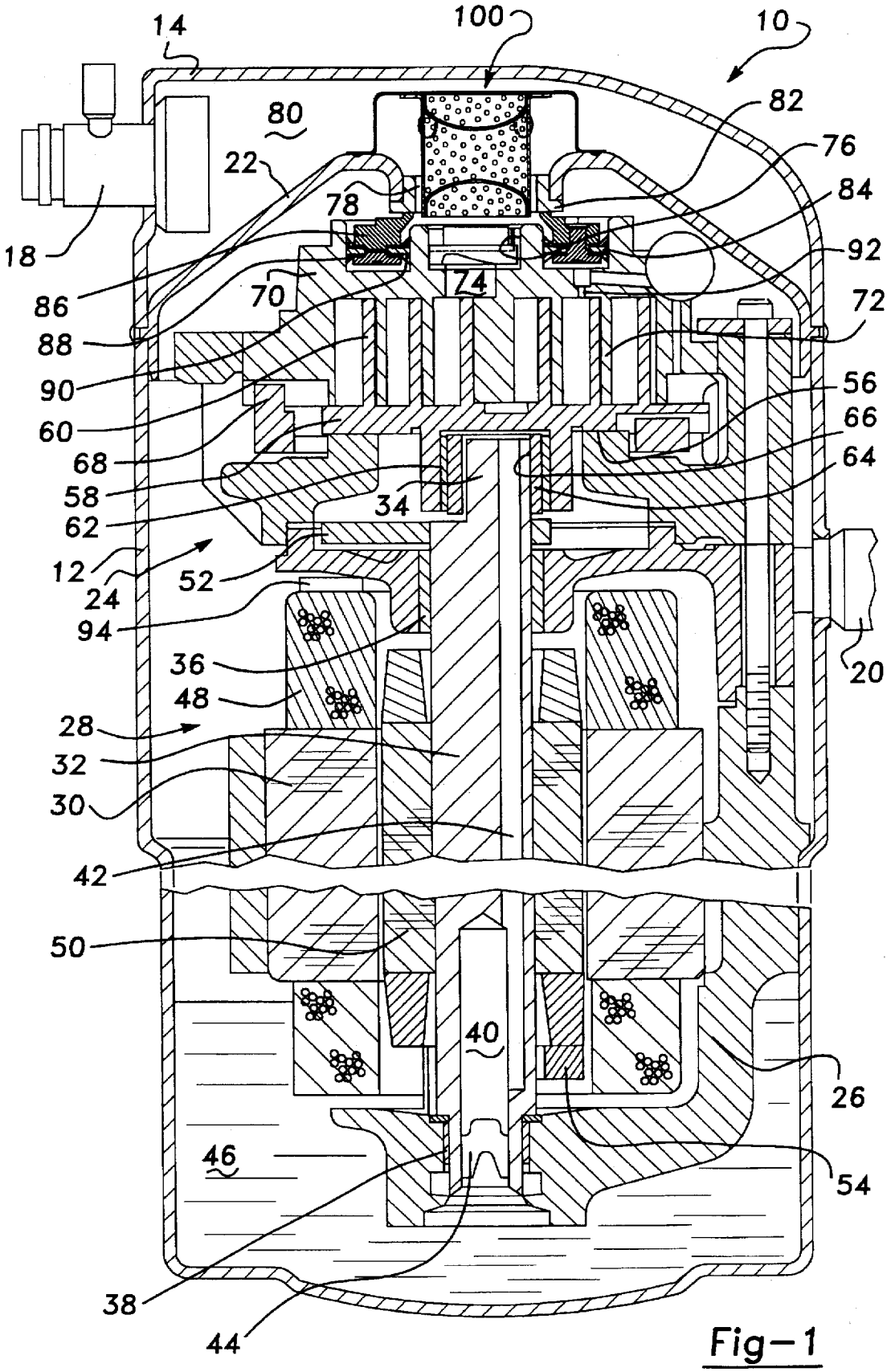
FIG. 1 is a vertical sectional view through the center of a scroll compressor which incorporates a muffler assembly in accordance with the present invention.
Figure 2:
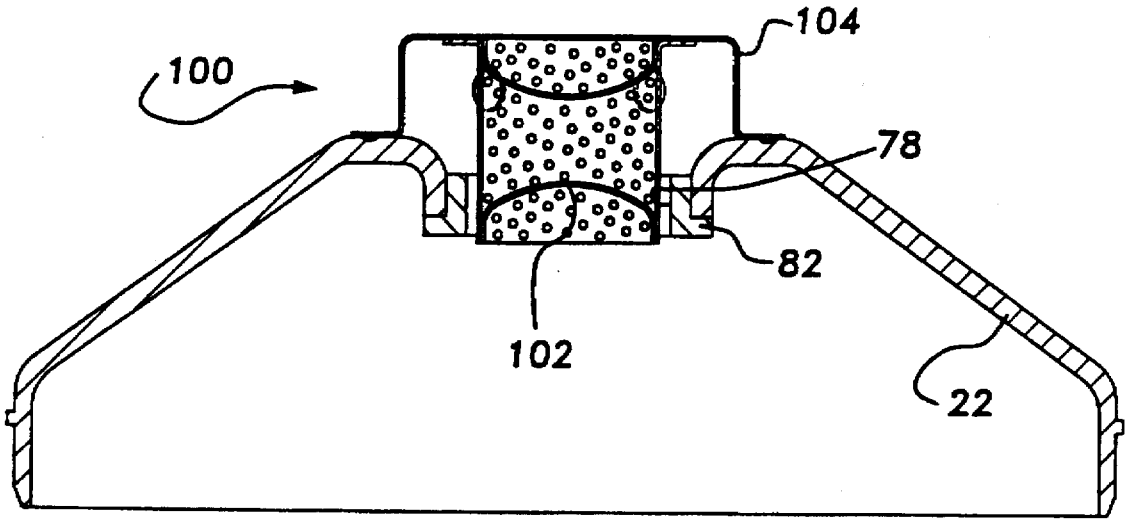
FIG. 2 is a vertical sectional view through the center of the partition and muffler assembly shown in FIG. 1.
Figure 3:
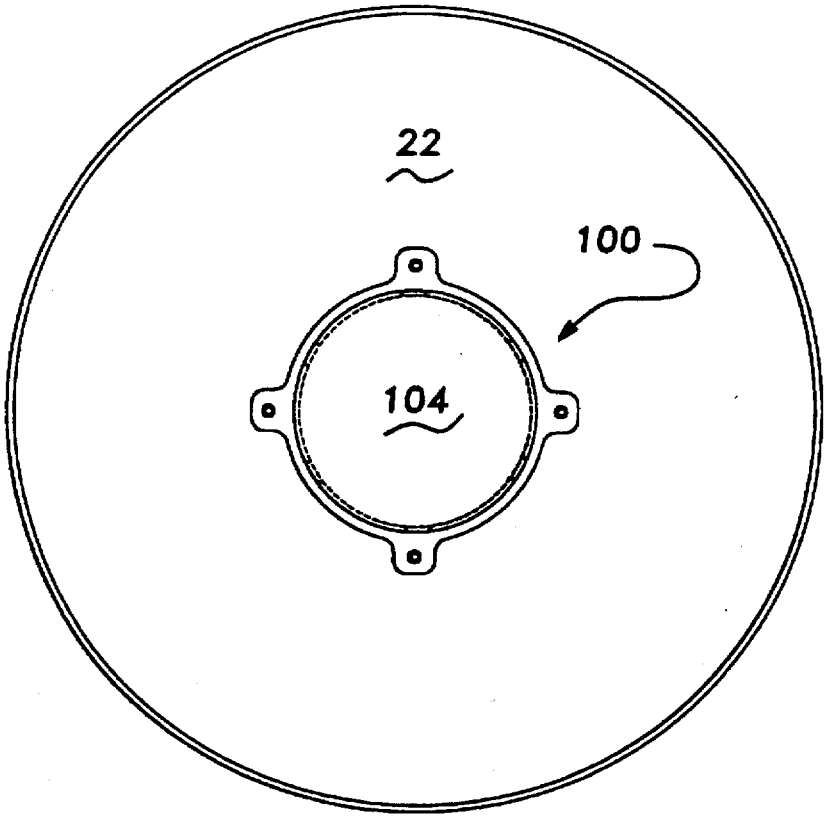
FIG. 3 is a top plan view of the partition and muffler assembly shown in FIG. 2.
Figure 4:
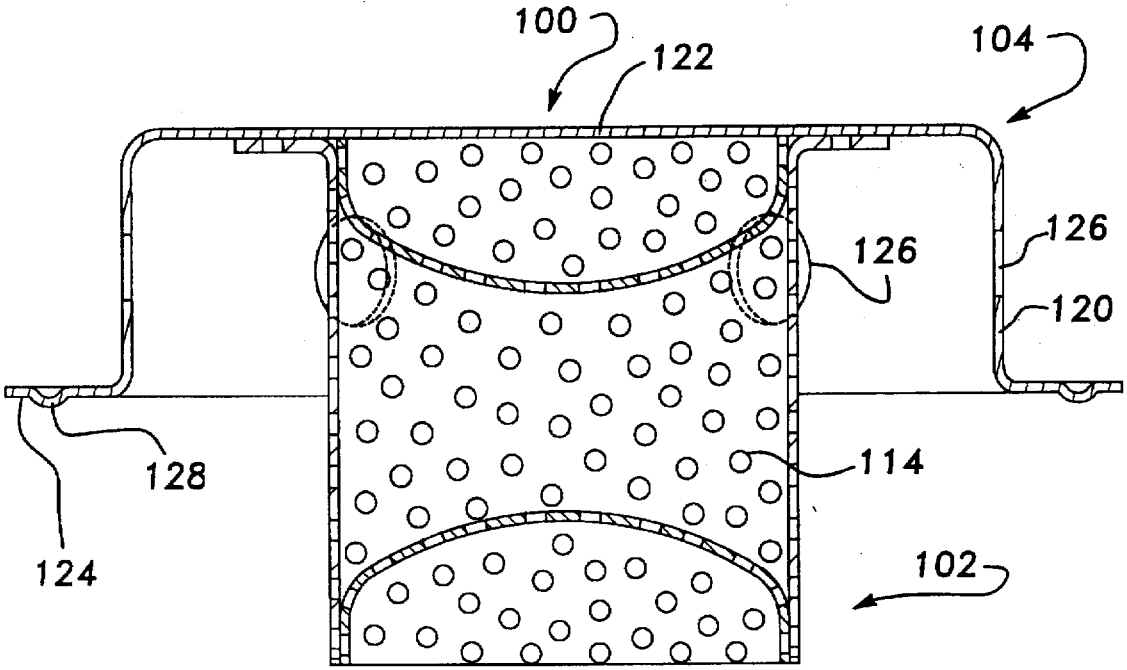
FIG. 4 is a vertical sectional view through the muffler assembly shown in FIGS. 1–3.
Figure 5:
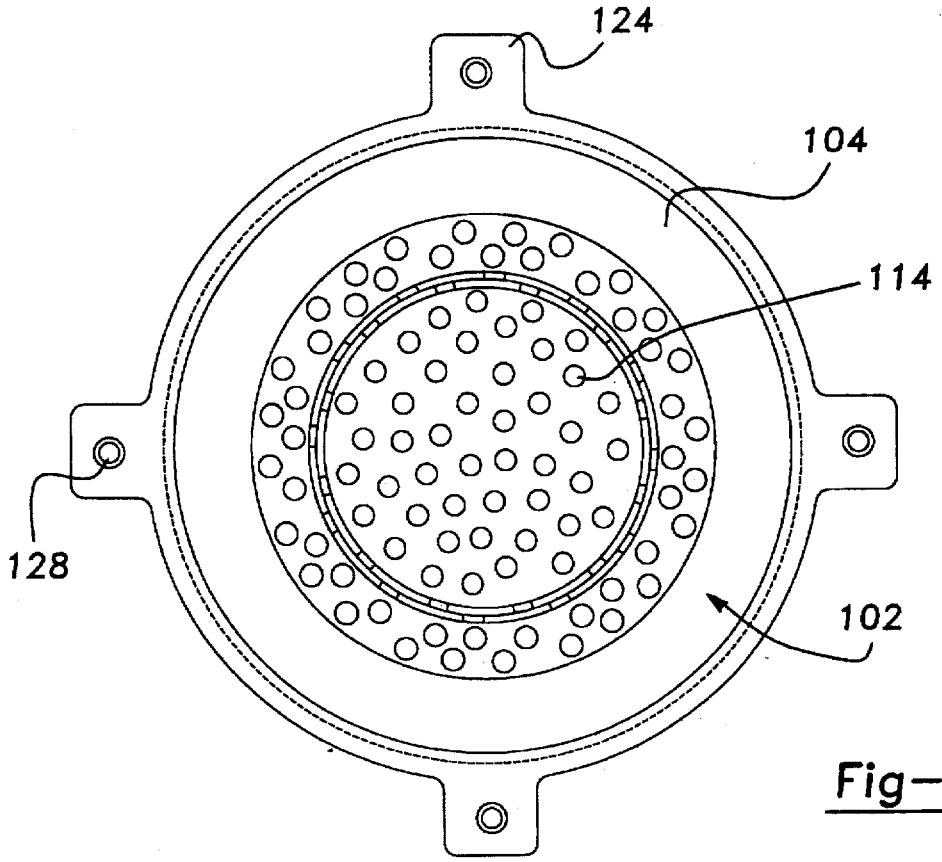
FIG. 5 is a bottom plan view of the muffler assembly shown in FIG. 4.
Figure 6:
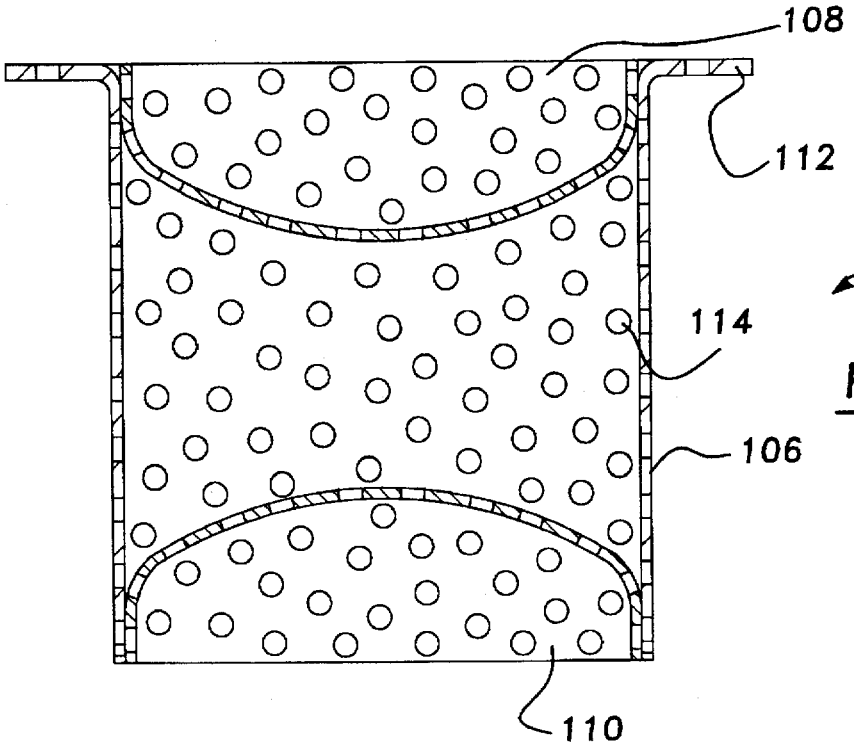
FIG. 6 is a vertical sectional view through the muffler shown in FIGS. 1–5.
Figure 7:
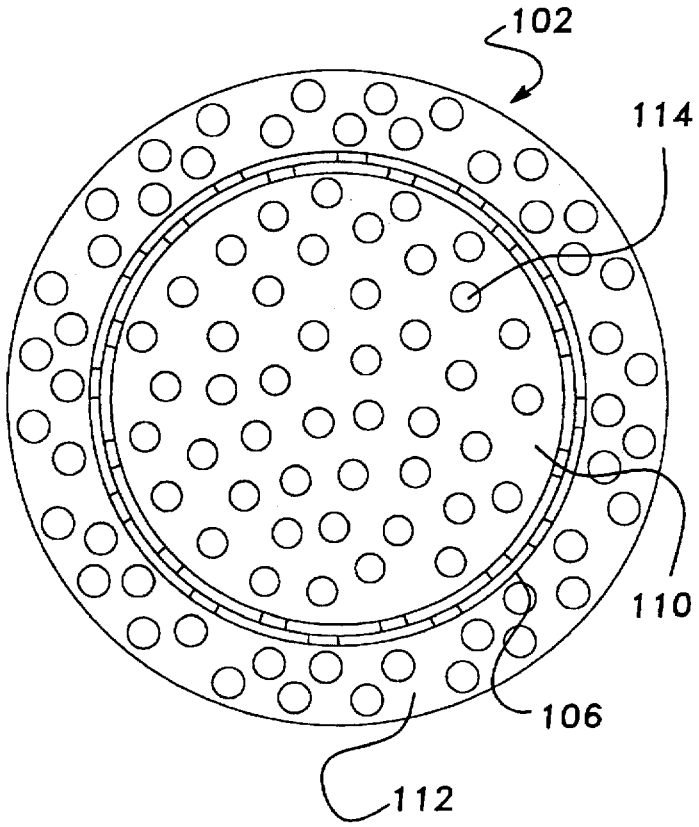
FIG. 7 is a bottom plan view of the muffler shown in FIG. 6.

While the present invention is suitable for incorporation in many different types of scroll machines, for exemplary purposes it will be described herein incorporated in a scroll refrigerant compressor of the general structure illustrated in FIG. 1. Referring now the drawings and in particular to FIG. 1, a compressor 10 is shown which comprises a generally cylindrical hermetic shell 12 having welded at the upper end thereof a cap 14. Cap 14 is provided with a refrigerant discharge fitting 18 which may have the usual discharge valve therein (not shown). Other major elements affixed to the shell include an inlet fitting 21, a transversely extending partition 22 which is welded about its periphery at the same point that cap 14 is welded to shell 12, a two piece main bearing housing 24 and a lower bearing housing 26 having a plurality of radially outwardly extending legs each of which is suitably secured to shell 12. Lower bearing housing 26 locates and supports within shell 12 two piece main bearing housing 24 and a motor 28 which includes a motor stator 30. A drive shaft or crankshaft 32 having an eccentric crank pin 34 at the upper end thereof is rotatably journalled in a bearing 36 in main bearing housing 24 and a second bearing 38 in lower bearing housing 26. Crankshaft 32 has at the lower end a relatively large diameter concentric bore 40 which communicates with a radially outwardly inclined smaller diameter bore 42 extending upwardly therefrom to the top of crankshaft 32. Disposed within bore 40 is a stirrer 44. The lower portion of the interior shell 12 defines an oil sump 46 which is filled with lubricating oil. Bore 40 acts as a pump to pump lubricating fluid up the crankshaft 32 and into bore 42 and ultimately to all of the various portions of the compressor which require lubrication.

Crankshaft 32 is rotatively driven by electric motor 28 including motor stator 30, windings 48 passing therethrough and a motor rotor 50 press fitted on crankshaft 32 and having upper and lower counterweights 52 and 54, respectively.

The upper surface of two piece main bearing housing 24 is provided with a flat thrust bearing surface 56 on which is disposed an orbiting scroll 56 having the usual spiral vane or wrap 60 on the upper surface thereof. Projecting downwardly from the lower surface of orbiting scroll 58 is a cylindrical hub having a journal bearing 62 therein and in which is rotatively disposed a drive bushing 64 having an inner bore 66 in which crank pin 34 is drivingly disposed. Crank pin 34 has a flat on one surface which drivingly engages a flat surface (not shown) formed in a portion of bore 66 to provide a radially compliant driving arrangement, such as shown in assignee's U.S. Pat. No. 4,877,382, the disclosure of which is hereby incorporated herein by reference. An Oldham coupling 58 is also provided positioned between orbiting scroll 58 and bearing housing 24. Oldham coupling 58 is keyed to orbiting scroll 58 and a non-orbiting scroll 70 to prevent rotational movement of orbiting scroll member 58. Oldham coupling 58 is preferably of the type disclosed in assignee's U.S. Pat. No. 5,320,506, the disclosure of which is hereby incorporated herein by reference.

Non-orbiting scroll member 70 is also provided having a wrap 72 positioned in meshing engagement with wrap 60 of orbiting scroll 58. Non-orbiting scroll 70 has a centrally disposed discharge passage 74 which communicates with an upwardly open recess 76 which in turn is in fluid communication via an opening 78 in partition 22 with a discharge muffler chamber 80 defined by cap 14 and partition 22. The entrance to opening 78 has an annular seat portion 82 therearound. Non-orbiting scroll member 70 has in the upper surface thereof an annular recess 34 having parallel coaxial sidewalls in which is sealingly disposed for relative axial movement an annular floating seal 86 which serves to isolate the bottom of recess 64 from the presence of gas under suction pressure at 88 and discharge pressure at 90 so that it can be placed in fluid communication with a source of intermediate fluid pressure by means of a passageway 92. Non-orbiting scroll member 70 is thus axially biased against orbiting scroll member 58 to enhance wrap tip sealing by the forces created by discharge pressure acting on the central portion of scroll member 70 and those created by intermediate fluid pressure acting on the bottom of recess 84. Discharge gas in recess 76 and opening 78 is also sealed from gas at suction pressure in the shell by means of seal 86 acting against seat portion 82. This axial pressure biasing and the functioning of floating seal 86 are disclosed in greater detail in assignee's U.S. Pat. No. 5,156,539, the disclosure of which is hereby incorporated herein by reference. Non-orbiting scroll member 70 is designed to be mounted to bearing housing 24 in a suitable manner which will provide limited axial (and no rotational) movement of non-orbiting scroll member 70. Non-orbiting scroll member 70 may be mounted in the manner disclosed in the aforementioned U.S. Pat. No. 4,877,382 or U.S. Pat. No. 5,102,316, the disclosure of which is hereby incorporated herein by reference.

The compressor is preferably of the "low side" type in which suction gas entering via fitting 20 is allowed, in part, to escape into the shell and assist in cooling the motor. So long as there is an adequate flow of returning suction gas the motor will remain within desired temperature limits. When this flow ceases, however, the loss of cooling will cause a motor protector 94 to trip and shut the machine down.

The scroll compressor as thus far broadly described is either now known in the art or is the subject of other pending applications for patent or patents of applicant's assignee.

The present invention is directed toward a unique muffler assembly 100 which is fixedly secured to partition 22 in line with the flow of compressed refrigerant exiting discharge passage 74 and entering discharge chamber 80 through recess 76 and opening 78. Muffler assembly 100 comprises a muffler 102 and a top cap 104.

Referring now to FIGS. 4–7, muffler 102 comprises a generally cylindrical housing 106 and a generally spherical upper and lower end cap 108 and 110, respectively. Housing 106 defines an annular flange 112 which facilitates the attachment of muffler 102 to top cap 104. End caps 108 and 110 are inserted into opposite ends of housing 106 and are secured to housing 108 by tack welding or any other method known in the art. Housing 106 and end caps 108 and 110 are preferably manufactured from carbon steel which defines a plurality of perforations 114 which extend through the material. The size, quantity and spacing of perforations 114 are selected to provide 20% to 50% of open area with respect to the entire area of the material being used it has been found that perforations 114 which account for 41% of the total area perform significantly better than perforations 114 which account for 21% of the total surface area.

Top cap 104 is a generally cylindrical member having an annular outside wall 120, an end cover 122 and a plurality of tabs 124. Muffler 102 is secured to end cover 122 by spot welding or any other method known in the art. Outside wall 120 defines a plurality of through bores 126 which allow for the passage of the compressed working fluid through top cap 104.

Muffler assembly 100 is secured to partition 22 by spot welding each of the plurality of tabs 124 to partition 22. A welding projection 128 can be formed on each tab 124 to facilitate the welding process if desired. While muffler assembly 100 is being shown as being welded to partition 22, it is within the scope of the present invention to attach muffler assembly 100 to partition 22 by any other means known in the art. Muffler assembly 100 is attached to partition 22 such that a clearance is maintained between top cap 104 and cap 14 of the compressor 10 to ensure there is no contact between these components during the operation of compressor 10. The welding of the plurality of tabs 124 to partition 22 positions muffler 102 within opening 78 defined by partition 22 and within the inside diameter of annular seat portion 82. A specific clearance is maintained between muffler 102 and the inside diameter of seat portion 82 to ensure there is no contact between these components during the operation of compressor 10.

Thus, compressed fluid from the enclosed spaces defining by wrap 60 of orbiting scroll 58 intermeshing with wrap 72 of scroll member 70 exits through discharge passage 74, through recess 76 and enters muffler 102. The compressed fluid travels through perforations 114, into the area between muffler 102 and top cap 104 and enters discharge muffler chamber 80 through the plurality of bores 126. The routing of the compressed fluid through muffler assembly 100 significantly reduces the operational noises generated by the operation of compressor 10.

While the above detailed description describes the preferred embodiment of the present invention, it should be understood that the present invention is susceptible to modification, variation and alteration without deviating from the scope and fair meaning of the subjoined claims.

What is claimed is:

1. A scroll machine comprising:

a shell;

a first scroll member disposed in said shell and having a first spiral wrap;

a second scroll member disposed in said shell and having second spiral wrap, said spiral wraps being mutually intermeshed;

means for causing said scroll members to orbit with respect to one another, whereby said wraps create at least one enclosed space of progressively changing volume between suction port defined by said scroll members and centrally located discharge port defined by one of said first and second scroll members;

a partition defining a discharge chamber and a suction chamber within said shell, said discharge port being in communication with said discharge chamber through a central opening defined by said partition; and a muffler assembly disposed between said discharge port and said discharge chamber, said muffler assembly comprising:

a generally cylindrical muffler defining a plurality of perforations, said muffler being aligned with said discharge port;

a top cap attached to said generally cylindrical member, said top cap including a solid wall for closing one end of said generally cylindrical muffler, said top cap being attached to another element of said scroll machine; and a first end cap secured to a first end of said muffler, said first end cap defining a plurality of perforations extending through said first end cap.

2. The scroll machine according to claim 1 wherein, said first end cap includes a generally spherical surface.

3. The scroll machine according to claim 1 wherein said plurality of perforations account for 20% to 50% of the total area of said muffler.

4. The scroll machine according to claim 3 wherein said 20% to 50% of the total area comprises approximately 41% of the total area.

5. The scroll machine according to claim 1 wherein, said muffler assembly further comprises a second end cap secured to a second end of said muffler, said second end cap defining a plurality of perforations extending through said second end cap.

6. The scroll machine according to claim 5 wherein said plurality of perforations extending through said muffler and through said first and second end caps account for 20% to 50% of the total area of said muffler and said first and second end caps.

7. The scroll machine according to claim 6 wherein, said 20% to 50% of the total area comprises approximately 41% of the total area.

8. The scroll machine according to claim 6 wherein said first and second end caps each include a generally spherical surface.

9. The scroll machine according to claim 1 wherein, said top cap includes an annular wall having a plurality of perforations extending through said annular wall.

10. The scroll machine according to claim 9 wherein said plurality of perforations account for 20% to 50% of the total area of said muffler.

11. The scroll machine according to claim 9 wherein, said first end cap includes a generally spherical surface.

12. The scroll machine according to claim 9 wherein, said muffler assembly further comprises a second end cap secured to a second end of said muffler, said second end cap defining a plurality of perforations extending through said second end cap.

13. The scroll machine according to claim 12 wherein said plurality of perforations extending through said muffler and through said first and second end caps account for 20% to 50% of the total area of said muffler and said first and second end caps.

14. The scroll machine according to claim 13 wherein said first and second end caps each include a generally spherical surface.

* * * * *

UNITED STATES PATENT AND TRADEMARK OFFICE

CERTIFICATE OF CORRECTION

PATENT NO. : 5,667,371

DATED : September 16, 1997

INVENTOR(S) : Werner H. Prenger; Sunil S. Kulkarni

It is certified that error appears in the above-indentified patent and that said Letters Patent is hereby corrected as shown below:

Column 1, line 66, after "canter" should be -- center --.

Column 2, line 32, after "now" insert -- to --.

Column 2, line 38, after "21" should be -- 20 --.

Column 2, line 65, "56" should be -- 58 --.

Column 3, line 9, "58" should be "68".

Column 3, line 11, "58" (first occurrence) should be "68".

Column 3, line 13, "58" should be "68" (second occurrence).

Column 3, line 24, "34" should be -- 84 --.

Column 3, line 27, "64" should be "84".

Column 4, line 5, "108" should be -- 106 --.

Column 4, line 11, after "used" insert -- . --.

Column 4, line 11, "it" should be -- It --.

Column 4, line 40, "defining" should be -- defined --.

UNITED STATES PATENT AND TRADEMARK OFFICE

CERTIFICATE OF CORRECTION

PATENT NO. : 5,667,371

DATED : September 16, 1997

INVENTOR(S) : Werner H. Prenger; Sunil S. Kulkarni

It is certified that error appears in the above-identified patent and that said Letters Patent is hereby corrected as shown below:

Column 4, line 61, after "having" insert -- a --.

Column 4, line 67, after "between" insert -- a --.

Column 5, line 1, after "and" insert -- a --.

Column 5, line 21, after "wherein" delete -- , --.

Column 5, line 29, after "wherein" delete -- , --.

Column 6, line 6, after "wherein" delete -- , --.

Column 6, line 11, after "wherein" delete -- , --.

Column 6, line 17, after "wherein" delete -- , --.

Column 6, line 19, after "wherein" delete -- , --.

Signed and Sealed this

Third Day of February, 1998

*Attest:*

*Attesting Officer*

Bruce Lehman

BRUCE LEHMAN

*Commissioner of Patents and Trademarks*